US012654821B1

(12) United States Patent
Boyd et al.

(10) Patent No.: US 12,654,821 B1
(45) Date of Patent: Jun. 16, 2026

(54) POWERED WATER SPORT TOWER

(71) Applicant: Protomet Corporation, Oak Ridge, TN (US)

(72) Inventors: Stewart Boyd, Knoxville, TN (US); Dale Lambert, Knoxville, TN (US); Aaron Pierce, Knoxville, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 19/047,227

(22) Filed: Feb. 6, 2025

Related U.S. Application Data

(60) Provisional application No. 63/574,557, filed on Apr. 4, 2024.

(51) Int. Cl.

| | |
|---|---|
| ***B63B 34/67*** | (2020.01) |
| ***B63B 15/00*** | (2006.01) |
| ***B63B 17/00*** | (2006.01) |
| ***B63B 34/60*** | (2020.01) |

(52) U.S. Cl.
CPC ..... *B63B 34/67* (2020.02); *B63B 15/00* (2013.01); *B63B 17/00* (2013.01); *B63B 34/60* (2020.02)

(58) Field of Classification Search
CPC ... B63B 17/00; B63B 17/02; B63B 2017/026; B63B 15/00; B63B 34/60; B63B 34/67
USPC ..... 182/2.2, 2.8
See application file for complete search history.

(56) References Cited

U.S. PATENT DOCUMENTS

| | | | | | |
|---|---|---|---|---|---|
| 4,360,187 | A * | 11/1982 | Chapman | B66F 5/04 | 254/8 R |
| 4,512,436 | A * | 4/1985 | Freudenthal | B66F 11/044 | 182/2.2 |
| 5,016,731 | A * | 5/1991 | Holmes | B66F 11/044 | 254/228 |
| 5,037,068 | A * | 8/1991 | Grottesi | B66F 11/048 | 254/8 R |
| 5,044,298 | A * | 9/1991 | Pepper | B63B 17/02 | 114/361 |
| 6,666,163 | B2 * | 12/2003 | Pastor | B63B 17/02 | 114/361 |
| 6,698,371 | B1 * | 3/2004 | Stoltzfus | B66F 11/044 | 114/61.1 |
| 7,373,897 | B2 * | 5/2008 | Tufte | B63B 17/02 | 114/361 |
| 8,187,045 | B2 * | 5/2012 | Thibodaux | B66C 23/605 | 440/37 |
| 8,196,542 | B2 | 6/2012 | Oswell et al. | | |
| 8,205,571 | B1 * | 6/2012 | Rondeau | B63B 17/02 | 114/361 |

(Continued)

*Primary Examiner* — Ajay Vasudeva
(74) *Attorney, Agent, or Firm* — Robinson IP Law, PLLC

(57) ABSTRACT

Various implementations include a tower having one or more legs, a top section, and a linkage mechanism. Each leg includes at least one leg portion and a mount for coupling the tower to a water craft. A proximal end of one leg portion is rotationally coupled to the mount. A distal end of each leg portion is rotationally coupled sequentially to the proximal end of another leg portion. The top section is rotationally coupled to the distal end of the last leg portion of each leg. The leg portions of each leg are rotatable such that the tower is movable between a lowered position and a raised position. The linkage mechanism rotationally clocks the rotational movement of the mount to the top section causing the top section to be non-rotatable relative to the mount of the leg.

9 Claims, 4 Drawing Sheets

(56) References Cited

U.S. PATENT DOCUMENTS

| | | | | |
|---|---|---|---|---|
| 9,061,748 | B2 | 6/2015 | Metcalf | |
| 9,095,981 | B2 * | 8/2015 | Brown | B25J 9/0006 |
| 9,180,943 | B2 | 11/2015 | Oswell et al. | |
| 9,434,451 | B1 | 9/2016 | Ostmeyer et al. | |
| 9,580,155 | B2 | 2/2017 | Lake et al. | |
| 11,345,444 | B2 | 5/2022 | Mills et al. | |
| 11,383,798 | B2 | 7/2022 | Wilson et al. | |
| 12,312,044 | B1 * | 5/2025 | Messick | B63B 43/18 |
| 2023/0303217 | A1 | 9/2023 | Wilson et al. | |
| 2024/0083548 | A1 * | 3/2024 | Bestul | B63B 3/48 |

* cited by examiner

POWERED WATER SPORT TOWER

BACKGROUND

Vehicles such as water craft are sometimes used for water board-sports. It can be desirable to have a tower coupled to and extending above the water craft so that a tow rope can be attached. This allows the tow rope to pull a water sports board user in an upward direction away from the water.

As noted above, towers extend above a water craft, which can cause clearance issues (e.g., under short bridges). Some current towers are able to pivot at one or more points along the tower to allow the user to collapse all or part of the tower. However, if other objects are coupled to the top section of the tower, such as a Bimini or speakers, those objects can become rotated as the tower is lowered, which can create further issues.

Thus, a need exists for a tower that can keep the top section of the tower level while the tower is being lowered.

SUMMARY

Various implementations include a tower. The tower includes one or more legs, a top section, and a linkage mechanism. Each leg includes a mount and at least one leg portion. The mount is for coupling the tower to a water craft. The at least one leg portion has a proximal end and a distal end distal to the proximal end. The proximal end of a first leg portion of the one or more leg portions is rotationally coupled to the mount about a first joint. The distal end of each of the one or more leg portions is coupled sequentially to the proximal end of another of the one or more leg portions. The top section is rotationally coupled to the distal end of a last leg portion of the sequentially coupled one or more leg portions of each of the one or more legs. The linkage mechanism extends from the mount to the distal end of a last leg portion of the sequentially coupled one or more leg portions of at least one of the one or more legs. The linkage mechanism rotationally clocks the rotational movement of the mount of the at least one of the one or more legs to the top section. The leg portions of each leg are rotatable such that the tower is movable between a lowered position and a raised position. The top section is further from the mount of each of the one or more legs in the raised position than it is in the lowered position. The rotational clocking of the mount of the at least one of the one or more legs to the top section caused by the linkage mechanism causes the top section to be non-rotatable relative to the mount of the at least one of the one or more legs.

In some implementations, the at least one leg portion further includes a second leg portion. In some implementations, the proximal end of the second leg portion is rotationally coupled to the distal end of the first leg portion. In some implementations, when the tower is moved from the lowered position toward the raised position, the first leg portion has a first rotational direction and the second leg portion has a second rotational direction opposite the first rotational direction.

In some implementations, the linkage mechanism includes a tether. In some implementations, the tether includes a belt or chain. In some implementations, the tether includes a cable.

In some implementations, the linkage mechanism includes two or more pulleys or gears. In some implementations, the two or more pulleys or gears are rotationally static relative to the mount. In some implementations, the two or more pulleys or gears are rotationally static relative to the top section. in some implementations, each of the two or more pulleys or gears have a 1:1 gear ratio to each other.

In some implementations, the tower further includes one or more rotational locks configured to selectively prevent the rotation of at least one rotational coupling of at least one leg. In some implementations, the one or more rotational locks include electrical locks. In some implementations, the one or more rotational locks include mechanical locks.

In some implementations, the one or more legs includes two legs.

In some implementations, the distal end of the last leg portion of the sequentially coupled one or more leg portions of each of the two legs are closer to each other than the proximal end of the first leg portion of each of the two legs. In some implementations, a rotational axis of at least one rotational coupling of one of the two legs is parallel to a rotational axis of at least one rotational coupling of another of the two legs. In some implementations, the linkage mechanism includes two or more pulleys or gears and one or more belts each extending around two of the two or more pulleys or gears. In some implementations, a rotational axis of at least one rotational coupling of one of the two legs and a plane including the one or more belt form an oblique angle.

In some implementations, the linkage mechanism includes two or more pulleys or gears and one or more cables each extending between two of the two or more pulleys or gears In some implementations, a rotational axis of at least one rotational coupling of one of the two legs and a plane including the one or more cables form an oblique angle.

In some implementations, at least one pulley or gear includes a constant velocity (CV) joint.

In some implementations, the tower further includes an actuator for moving the tower between the raised position and the lowered position. In some implementations, the actuator includes a linear actuator. In some implementations, the actuator includes a motor.

BRIEF DESCRIPTION OF DRAWINGS

Example features and implementations of the present disclosure are disclosed in the accompanying drawings. However, the present disclosure is not limited to the precise arrangements and instrumentalities shown. Similar elements in different implementations are designated using the same reference numerals.

DETAILED DESCRIPTION

Figure 1B:
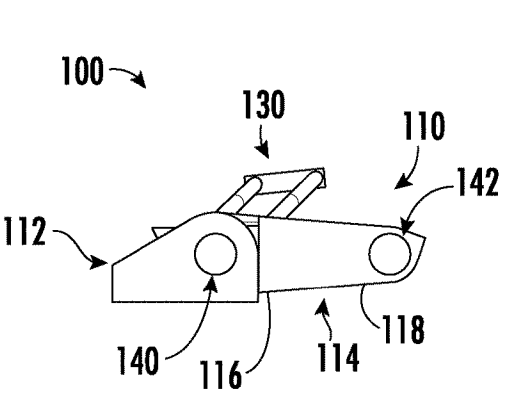
FIG. 1B is a side view of the tower of FIG. 1A in the lowered position.
Figure 1D:
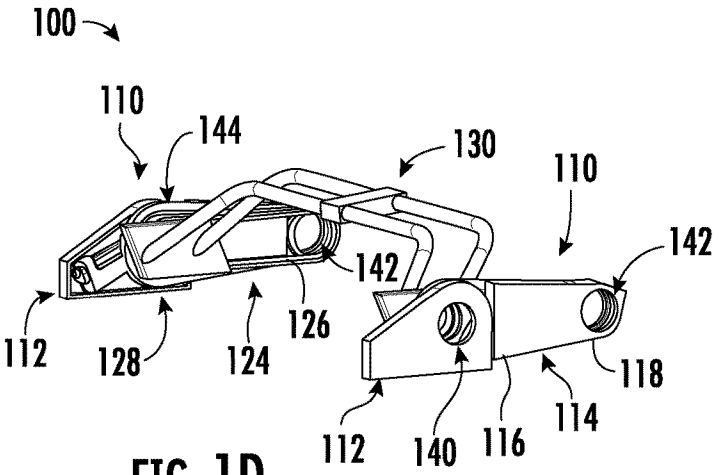
FIG. 1D is a perspective view of the tower of FIG. 1A in the lowered position.
Figure 1A:
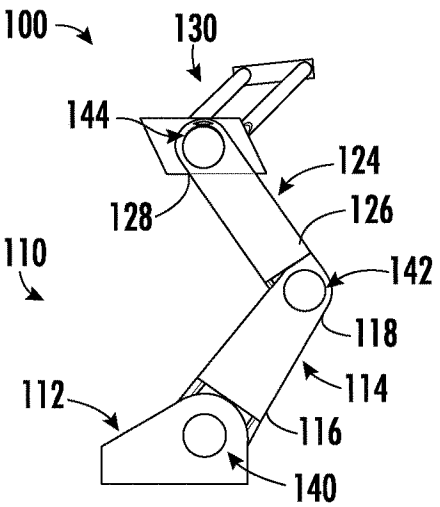
FIG. 1A is a side view of a tower in the raised position, according to one implementation.
Figure 1C:
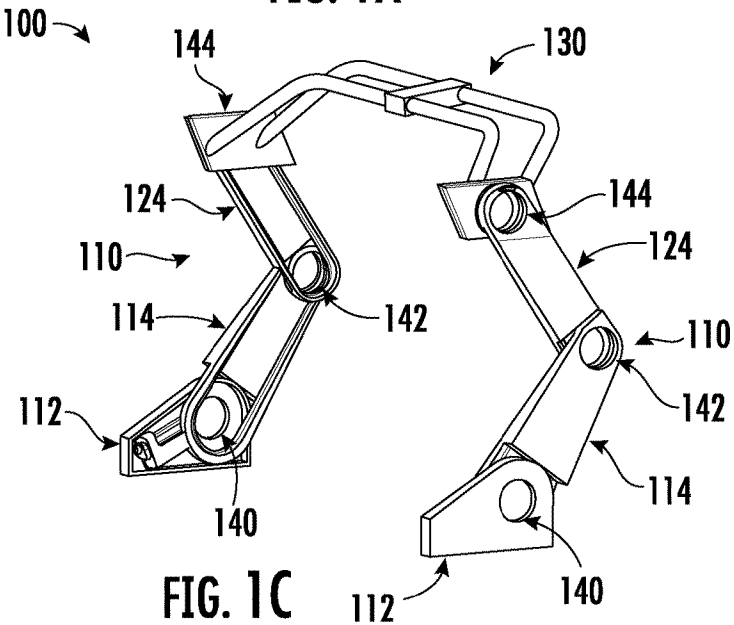
FIG. 1C is a perspective view of the tower of FIG. 1A in the raised position.
Figure 2B:
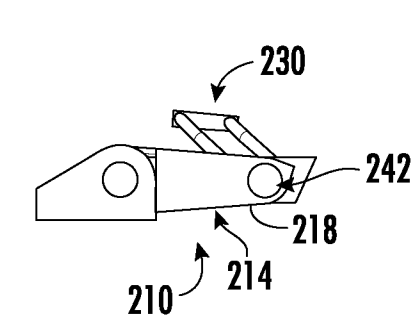
FIG. 2B is a side view of the tower of FIG. 2A in the lowered position.
Figure 2D:
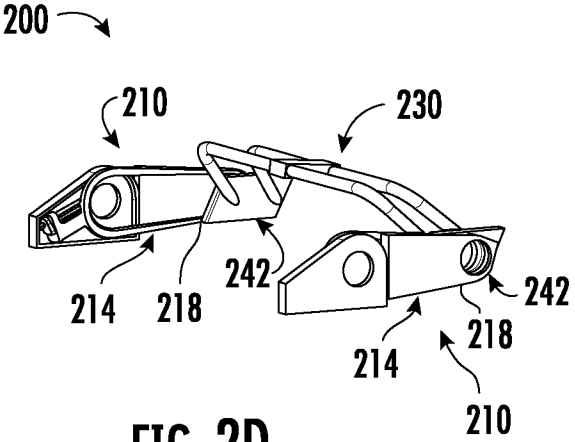
FIG. 2D is a perspective view of the tower of FIG. 2A in the lowered position.
Figure 2A:
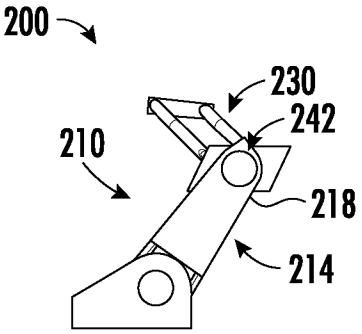
FIG. 2A is a side view of a tower in the raised position, according to another implementation.
Figure 2C:
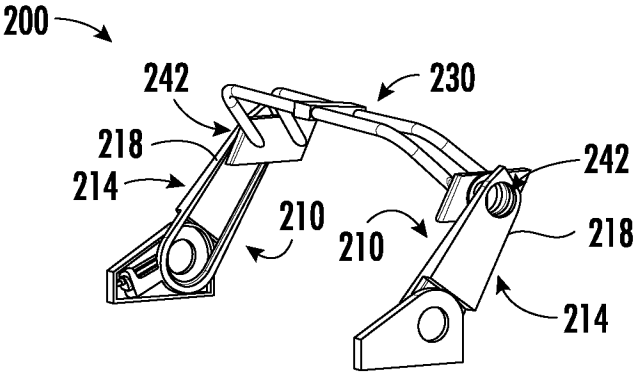
FIG. 2C is a perspective view of the tower of FIG. 2A in the raised position.

The devices, systems, and methods disclosed herein provide for a powered water sport tower. The tower includes a top section and two legs each with a mount and one or more leg portions. The mount of each leg is configured to be coupled to a portion of a watercraft. The one or more leg portions of each leg are sequentially end-to-end from the respective mount to the top section of the tower. Each leg portion is rotatable relative to the respective mount and to the top section. The tower is powered such that each rotation point is rotatable in an opposite direction from its neighboring rotation point to allow the tower to fold from a raised position to a lowered position.

The top section and at least one of the mounts are clocked to each other such that, as the tower moves between the raised position and the lowered position, the top section does not rotate relative to the mount.

The towers disclosed herein include a scalable number of tower leg portions (starting with one, can increase to two, three, etc.) that have pivot joints or rotational couplings at both ends. These rotational couplings allow for the components that bolt to the leg (tower base, upper/center section of tower, additional legs) to rotate relative to the leg.

A linkage internal to the leg clocks the rotation of the top section of the tower and at least one of the mounts so that they do not rotate relative to each other. The linkage can take the form of a tether such as a belt/chain and geared pulleys, a smooth belt and pulleys, static linkages (single or multiple), one or more cables acting similar to belts with a pulley, rack and pinions, or any other mechanism for clocking the relative rotation of two rotating and spaced apart objects.

Various implementations include a tower. The tower includes one or more legs, a top section, and a linkage mechanism. Each leg includes a mount and at least one leg portion. The mount is for coupling the tower to a water craft. The at least one leg portion has a proximal end and a distal end distal to the proximal end. The proximal end of a first leg portion of the one or more leg portions is rotationally coupled to the mount about a first joint. The distal end of each of the one or more leg portions is coupled sequentially to the proximal end of another of the one or more leg portions. The top section is rotationally coupled to the distal end of a last leg portion of the sequentially coupled one or more leg portions of each of the one or more legs. The linkage mechanism extends from the mount to the distal end of a last leg portion of the sequentially coupled one or more leg portions of at least one of the one or more legs. The linkage mechanism rotationally clocks the rotational movement of the mount of the at least one of the one or more legs to the top section. The leg portions of each leg are rotatable such that the tower is movable between a lowered position and a raised position. The top section is further from the mount of each of the one or more legs in the raised position than it is in the lowered position. The rotational clocking of the mount of the at least one of the one or more legs to the top section caused by the linkage mechanism causes the top section to be non-rotatable relative to the mount of the at least one of the one or more legs.

FIGS. 1A-1D and 3A-3C show a tower 100 having aspects included in various implementations. The tower 100 shown in FIGS. 1A-1D and 3A-3C includes two legs 110, a top section 130, and a linkage mechanism 150.

Each of the legs 110 includes a mount 112, a first leg portion 114, and a second leg portion 124. The mount 112 is for coupling the tower 100 to a water craft.

The first leg portion 114 has a proximal end 116 and a distal end 118 distal to the proximal end 116, and the second leg portion 124 has a proximal end 126 and a distal end 128 distal to the proximal end 126. The proximal end 116 of the first leg portion 114 of each leg 110 is rotationally coupled to the mount 112 of its respective leg 110 about a first joint 140. The distal end 118 of the first leg portion 114 is rotationally coupled to the proximal end 126 of the second leg portion 124 about a second joint 142. The distal end 128 of the second leg portion 124 of each leg 110 is rotationally coupled to a separate end of the top section 130 about a third joint 144.

In some implementations, such as the tower 200 shown in FIGS. 2A-2D, each of the two legs 210 includes only a first leg portion 214. In such implementations, the distal end 218 of the first leg portion 214 of each leg 210 is rotationally coupled to a separate end of the top section 230 about the second joint 242.

In some implementations, each leg of the tower can include three or more leg portions. In such implementations, the distal end of each leg portion is rotationally coupled sequentially to the proximal end of the next leg portion to create a new joint. The top section is rotationally coupled to the distal end of a last leg portion of the sequentially coupled leg portions of each of the legs.

In some implementations, the tower includes only one leg rotationally coupled to the top section. In some implementations, the tower includes three or more legs each rotationally coupled to the top section.

The linkage mechanism 150 shown in FIGS. 1A-1D and 3A-3C includes four pulleys 152, 154, 156, 158 and two belts 170, 172. When the leg portions 114, 124 of each leg 110 are rotated, the tower 100 is movable between a lowered position (shown in FIGS. 1B and 1D) and a raised position (shown in FIGS. 1A and 1C). The top section 130 is further from the mount 112 of each of the one or more legs 110 in the raised position than it is in the lowered position. The pulleys 152, 154, 156, 158 rotate relative to the leg portions 114, 124 as the leg portions 114, 124 rotate between the raise position and the lowered position, but the pulleys 152, 154, 156, 158 do not rotate relative to each other, the mounts 112, or the top section 130.

A first pulley 152 of the linkage mechanism 150 is disposed on a first shaft 160 extending from the mount 112 and the proximal end 116 of the first leg portion 114. The first shaft 160 has the same axis of rotation as the first joint 140. The first shaft 160 is non-rotatable relative to the mount 112, and the first pulley 152 is non-rotatable relative to the first shaft 160 and the mount 112. The first leg portion 114 is rotatable relative to the mount 112, the first shaft 160, and the first pulley 152.

A second pulley 154 of the linkage mechanism 150 is disposed on a second shaft 162 extending through the distal end 118 of the first leg portion 114 and the proximal end 126 of the second leg portion 124. The second shaft 162 has the same axis of rotation as the second joint 142. The second pulley 154 is coupled to the first pulley 152 by a first belt 170. The second pulley 154 is able to rotate freely relative to the distal end 118 of the first leg portion 114 and the proximal end 126 of the second leg portion 124. Because the second pulley 154 is located at the rotational coupling of the first leg portion 114 and the second leg portion 124, the second pulley 154 orbits the first pulley 152 and the mount 112. However, the first belt 170 clocks the first pulley 152 to the second pulley 154 such that the second pulley 154 does not rotate relative to the first pulley 152 and the mount 112 as the second pulley 154 orbits the first pulley 152 and the mount 112.

A third pulley 156 of the linkage mechanism 150 is disposed on the second shaft 162 and shares an axis of rotation with the second pulley 154. The third pulley 156 is rotationally clocked to the second pulley 154 (e.g., by both being statically coupled to the same shaft 162) and to the proximal end 126 of the second leg portion 124. Because the third pulley 156 is static relative to the proximal end 126 of the second leg portion 124, as the third pulley 156 is rotated relative to the rotational coupling between the first leg portion 114 and a second leg portion 124, the second leg portion 124 is caused to rotate relative to the first leg portion 114 in a rotational direction opposite the rotational direction of the mount 112 and the proximal end 116 of the first leg portion 114. However, the third pulley 156 is static relative to the second pulley 154 so it does not rotate relative to the mount 112, the first pulley 152, and the second pulley 154 as the third pulley 156 orbits the first pulley 152 and the mount 112.

A fourth pulley 158 of the linkage mechanism 150 is disposed on a third shaft 164 extending through the distal end 128 of the second leg portion 124 and the top section 130. The third shaft 164 has the same axis of rotation as the third joint 144. The fourth pulley 158 is rotational relative to the second leg portion 124 but is statically coupled to the top section 130 of the tower 100. The fourth pulley 158 is coupled to the third pulley 156 by a second belt 172.

Because the fourth pulley 158 is located at the rotational coupling of the second leg portion 124 and the top section 130, the fourth pulley 158 orbits the second 154 and third pulleys 156. However, the first belt 170 clocks the first pulley 152 to the second pulley 154, which is clocked to the third pulley 156, and the second belt 172 clocks the third pulley 156 to the fourth pulley 158 such that the fourth pulley 158 does not rotate relative to the first pulley 152 and the mount 112 as the fourth pulley 158 orbits the second 154 and third pulleys 156. Because the fourth pulley 158 is rotationally static relative to the top section 130, as the fourth pulley 158 is rotated relative to the rotational coupling of the second leg portion 124, the top section 130 is caused to rotate relative to the second leg portion 124 in a rotational direction opposite the rotational direction of the second joint 142 between the first leg portion 114 and the second leg portion 124 (but in the same rotational direction as the first joint 140 between the mount 112 and the first leg portion 114). However, because the top section 130 of the tower 100 is rotationally static relative to the fourth pulley 158 (and the first 152, second 154, and third pulleys 156), the top section 130 does not rotate relative to the mount 112 as the tower 100 is moved between the raised position and the lowered position.

By including pulleys 152, 154, 156, 158 with the same 1:1 gear ratio throughout the tower 100, the actuation between the raised position and the lowered position causes an equal and opposite rotation of components of the tower 100. The opposite and equal rotation holds angular orientation of the external components constant relative to the mounts 112 of the tower 100 (i.e., the components are clocked to the mounts 112). This allows for the tower 100 to be raised and lowered without changing the rotational angle of the top section 130 of the tower 100 relative to the mounts 112 and the water craft. This also ensures that the leg portions 114, 124 and top section 130 rotate at the same rate. In some implementations, it may desirable to have certain components rotate at a faster rate relative to other components. In such implementations, different gear ratios can be used to cause components to rotate at different relative rates.

Although the example provided includes two leg portions 114, 124, in some implementations, the tower include only one leg portion or more than two leg portions. When adding more leg portions, each leg portion shares one rotational coupling with the other, as described above. The linkage mechanism internal to the leg portions (e.g., a series of pulleys and belts) that links the rotation of the external components is shared between the common rotational coupling. This ensures that the motion of each subsequent leg portion (and whatever external component is affixed to it) remains linked to the rotation of the previous leg portion.

Figure 3C:
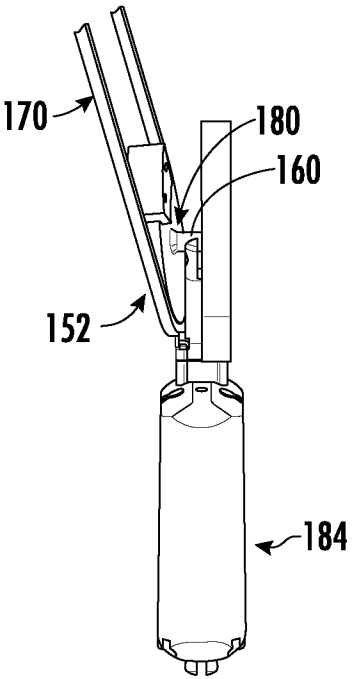
FIG. 3C is a detail view of a portion of the linkage mechanism of the tower of FIG. 1B shown within circle 3C.
Figure 3B:
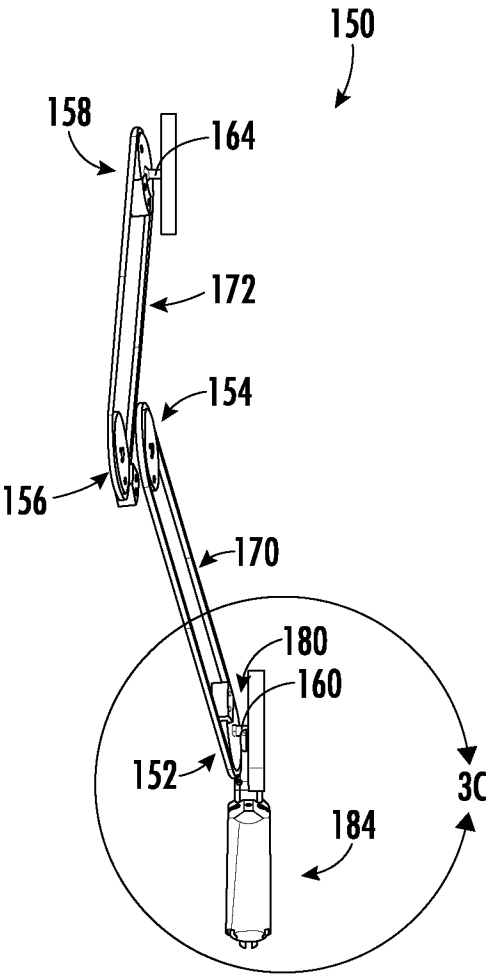
FIG. 3B is a rear view of the linkage mechanism of the tower of FIG. 1A.
Figure 3A:
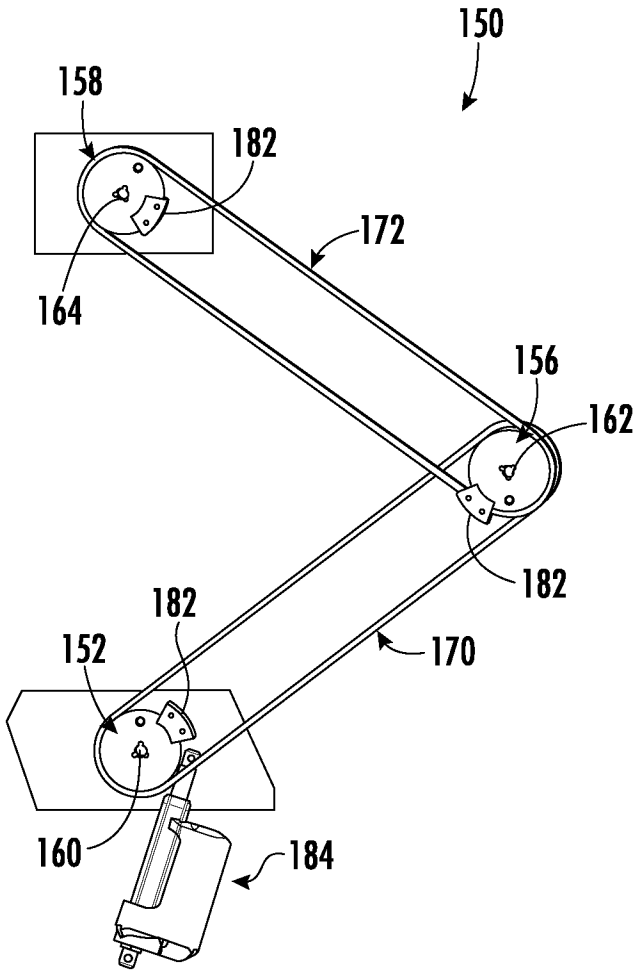
FIG. 3A is a side view of the linkage mechanism of the tower of FIG. 1A.

In some implementations, it is desired to tow the legs 110 of the tower 100 inwardly toward each other as they extend from the mount 112 to the top section 130, as shown in FIGS. 3A-3C. In such implementations, the distance between the joints or rotational couplings between a leg portion 114, 124 and the top section 130 is less than the distance between a leg portion 114, 124 and each of the two mounts 112 such that the tower 100 tapers toward the top section 130. This can present an issue because the rotational axes of the rotational couplings of one leg 110 may still be parallel to the rotational axes of the rotational couplings of the other leg 110 (i.e., the longitudinal axes of the first 160, second 162, and third shafts 164 are parallel). However, the belts 170, 172 must extend at an oblique angle to these axes. Thus, the pulleys 152, 154, 156, 158 should be cambered relative to their respective axis to allow the belt 170, 172 to ride smoothly between pulleys 152, 154, 156, 158. To achieve this effect, one or more pulleys 152, 154, 156, 158 of a leg 110 can include a constant velocity (CV) joint 180, which allows the pulley 152, 154, 156, 158 to wobble or precess about its axis. The tension of each belt 170, 172 causes the pulleys 152, 154, 156, 158 to which it is coupled to camber into alignment with each other and the CV joint 180 allows the pulley 152, 154, 156, 158 to precess about its axis as the pulleys 152, 154, 156, 158 orbit each other during movement of the tower position.

In some implementations, such as shown in FIGS. 3A-3C, the tower 100 also includes a rotational lock 182 to maintain the tower 100 in a desired position (e.g., the raised position, the lowered position, or any other intermediate position). The rotational lock 182 prevents the rotation of at least one rotational coupling 140, 142, 144 between two of the mount 112, a leg portion 114, 124, or the top section 130. When one rotational coupling 140, 142, 144 is prevented from rotating by the rotational lock 182, the other rotational couplings 140, 142, 144 that are clocked together by the linkage mechanism 150 are also prevented from rotating. The rotational lock 182 can be mechanical or electrical and can be activated either mechanically or electrically. The rotational lock 182 also allows the tower 100 to sustain loads placed on the tower 100 at various angles when the tower 100 is at any desired position. In some implementations, the tower includes two or more locks at different portions of tower to rotationally lock different components of the tower in a desired rotational position.

The tower 100 can be moved between the raised position and the lowered position by an actuator 184. The actuator 184 shown in FIGS. 1A-1D and 3A-3C is a linear actuator, but in some implementations, the actuator(s) can include a motor, a pneumatic actuator, or any other actuator capable of applying enough force to cause the rotation of the tower components about their rotational couplings between the lowered position and the raised position. The actuator 184 can directly drive the rotation of the leg portions 114, 124 of the tower 100 (as shown in FIGS. 3A-3C) or can be tethered (e.g., via belt or chain).

As discussed above, in some implementations, the linkage can take the form of a tether such as a belt/chain and geared pulleys, a smooth belt and pulleys, static linkages (single or multiple), one or more cables acting similar to belts with a pulley, rack and pinions, or any other mechanism for clocking the relative rotation of two rotating and spaced apart objects. For example, for the implementation of the tower 400 shown in FIGS. 4A-4C, the linkage mechanism 450 includes a cable and pulley system. This linkage mechanism 450 includes pulleys or disks 452, 456 connected by a first cable 470 and a second cable 474 that run along the length of the leg portion 414 housing. The pulleys or disks 452, 456 may be mounted and function similarly to the pulleys described in other implementations.

Each cable 470, 474 has a first cable end 471, 475 and a second cable end 472, 476. The first cable end 471 of the first cable 470 is coupled to a first portion 453 of the first pulley 452 adjacent a perimetrical edge, while the first cable end 475 of the second cable 474 is coupled to a second portion 454 of the first pulley 452 adjacent a perimetrical edge and opposite from the first cable end 471 of the first cable 470.

The second cable end 472 of the first cable 470 is coupled to a first portion 457 of the second pulley 456 adjacent a perimetrical edge, and the second cable end 476 of the second cable 474 is coupled to a second portion 458 of the second pulley 456 adjacent a perimetrical edge and opposite from the second cable end 472 of the first cable 470.

In this configuration, when an actuator 484 causes the first leg portion 414 to rotate relative to the mount 412, the second pulley 456 rotates around the mount 412. The first pulley 452 may remain static relative to the mount 412. As the first cable 470 and the second cable 474 couple the first pulley 452 to the second pulley 456, the first pulley 452 and the mount 412 may remain static or non-rotational relative to the second pulley 456 as the first leg portion 414 rotates relative to the mount 412.

In some implementations, additional leg portions may be included, incorporating additional pulleys and cables or other linkage mechanisms as described previously.

The leg 410 also includes an actuator 484 configured to cause the leg portion 414 to rotate relative to the mount 412, similar to other implementations.

Figure 4C:
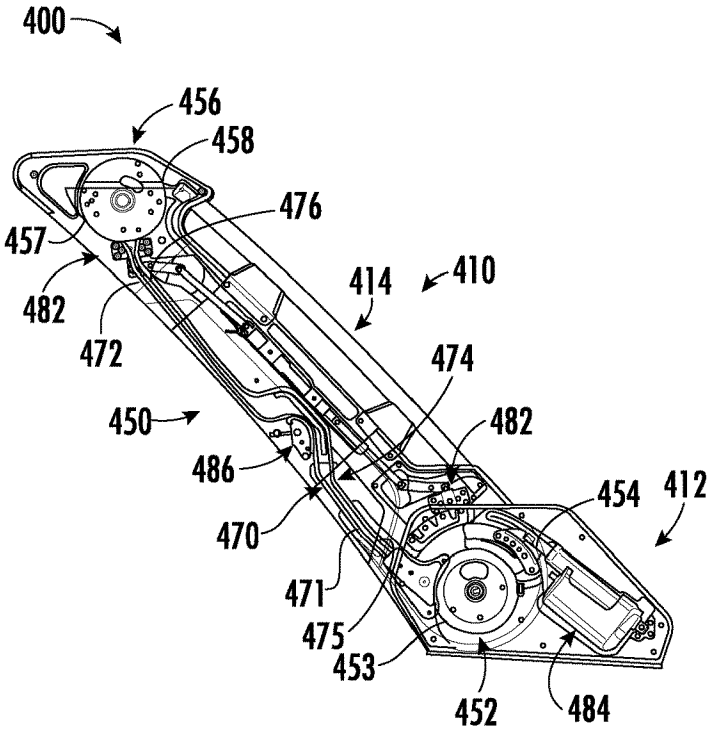
FIG. 4C shows a left side view of the leg portion of the tower of FIG. 4A.
Figure 4B:
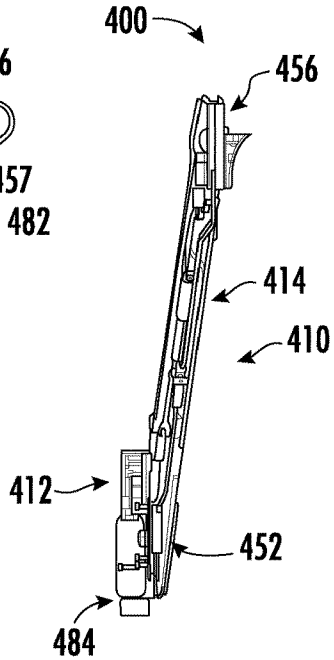
FIG. 4B shows a front view of the leg portion of the tower of FIG. 4A.
Figure 4A:
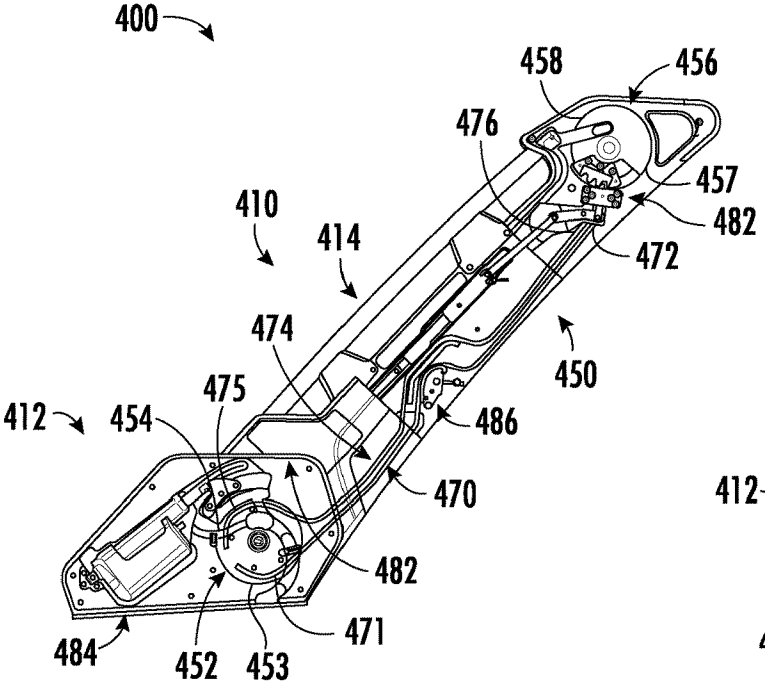
FIG. 4A shows a right side view of a leg portion of a tower, according to another implementation.

The linkage mechanism 450 shown in FIGS. 4A-4C further includes one or more tensioners 486 to adjust the tension of each of the first cable 470 and the second cable 474. Similar tensioners may be applied to other implementations as well (e.g., to tension belts).

The leg 410 also incorporates two rotational locks 482. The rotational locks 482 shown in FIGS. 4A-4C are electrically actuated pin locks, but in some implementations, the rotational locks 482 can be electrically or mechanically actuated pin locks, or both, to maintain the tower 400 in a desired position and prevent undesired movement.

The tower 400 shown in FIGS. 4A-4C can further include any of the other features described herein and shown in the figures with respect to any other implementations. Furthermore, the features described and shown in FIGS. 4A-4C can be incorporated in any of the other implementations described herein and shown in the figures.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A watersports tower comprising:

one or more legs, wherein each leg comprises:

a mount for coupling the tower to a water craft, and one or more leg portions having a proximal end and a distal end distal to the proximal end, wherein the proximal end of a first leg portion of the one or more leg portions is rotationally coupled to the mount about a first joint, wherein, when the one or more leg portions includes two or more leg portions, the distal end of each of the one or more leg portions except a last leg portion is coupled sequentially to the proximal end of a next leg portion of the one or more leg portions;

a top section rotationally coupled to the distal end of the last leg portion, wherein the last leg portion is a final leg portion in a sequential coupling of the one or more leg portions of each of the one or more legs; and a linkage mechanism extending from the mount to the distal end of the last leg portion of at least one of the one or more legs, wherein the linkage mechanism rotationally clocks a rotational relationship between the mount of the at least one of the one or more legs to the top section such that the mount and the top section do not rotate relative to each other, wherein the leg portions of each leg are rotatable such that the tower is movable between a lowered position and a raised position, wherein the top section is further from the mount of each of the one or more legs in the raised position than it is in the lowered position, wherein the rotational clocking of the rotational relationship between the mount of the at least one of the one or more legs and the top section caused by the linkage mechanism causes the top section to be non-rotatable relative to the mount of the at least one of the one or more legs, wherein the one or more legs comprise two legs, and wherein the distal end of the last leg portion of the sequentially coupled one or more leg portions of each of the two legs are closer to each other than the proximal end of the first leg portion of each of the two legs.

2. The tower of claim 1, wherein the one or more leg portions further comprises a first leg portion and a second leg portion, wherein the second leg portion is the next leg portion sequentially coupled to the first leg portion, and wherein the proximal end of the second leg portion is rotationally coupled to the distal end of the first leg portion.

3. The tower of claim 2, wherein, when the tower is moved from the lowered position toward the raised position, the first leg portion has a first rotational direction and the second leg portion has a second rotational direction opposite the first rotational direction.

4. The tower of claim 1, wherein the linkage mechanism includes a tether.

5. The tower of claim 4, wherein the tether includes a cable.

6. The tower of claim 1, wherein a rotational axis of at least one rotational coupling of one of the two legs is parallel to a rotational axis of at least one rotational coupling of another of the two legs.

7. The tower of claim 1, wherein at least one pulley or gear includes a constant velocity (CV) joint.

8. The tower of claim 1, further comprising an actuator for moving the tower between the raised position and the lowered position.

9. The tower of claim 8, wherein the actuator comprises a linear actuator.

* * * * *